United States Patent [19]

Hutchinson

[11] 4,231,001

[45] Oct. 28, 1980

[54] CONSTANT RESISTANCE COUPLING NETWORK

[75] Inventor: Ronald Hutchinson, Galleywood, England

[73] Assignee: The Marconi Company Limited, Chelmsford, England

[21] Appl. No.: 19,924

[22] Filed: Mar. 12, 1979

[30] Foreign Application Priority Data

Apr. 11, 1978 [GB] United Kingdom ..... 14088/78

[51] Int. Cl.[3] ..... H01P 5/18; H01P 1/213

[52] U.S. Cl. ..... 333/110; 333/135; 333/137; 333/230; 333/232

[58] Field of Search ..... 333/109–112, 333/117, 125, 126, 134–137, 227, 230, 231, 232

[56] References Cited

U.S. PATENT DOCUMENTS

| | | | |
|---|---|---|---|
| 2,486,818 | 11/1949 | Bowman | 333/111 |
| 3,886,499 | 5/1975 | Hutchinson | 333/110 |

*Primary Examiner*—Paul L. Gensler

*Attorney, Agent, or Firm*—Diller, Ramik & Wight

[57] ABSTRACT

A constant resistance network which exhibits frequency dependent characteristics consists of a cavity resonator having two coupling loops mounted parallel to the walls of the cavity. The resonant frequency of the cavity is primarily determined by the dimensions of a resonator plate whose frequency of resonance can be trimmed by adjusting the size of a slot. The network can be used for combining the different frequencies by arranging that one of the frequencies is at the resonant frequency of the plate. The network can be extended by the provision of additional resonator plates to provide a more complex frequency response.

12 Claims, 7 Drawing Figures

CONSTANT RESISTANCE COUPLING NETWORK

Figure 1A:
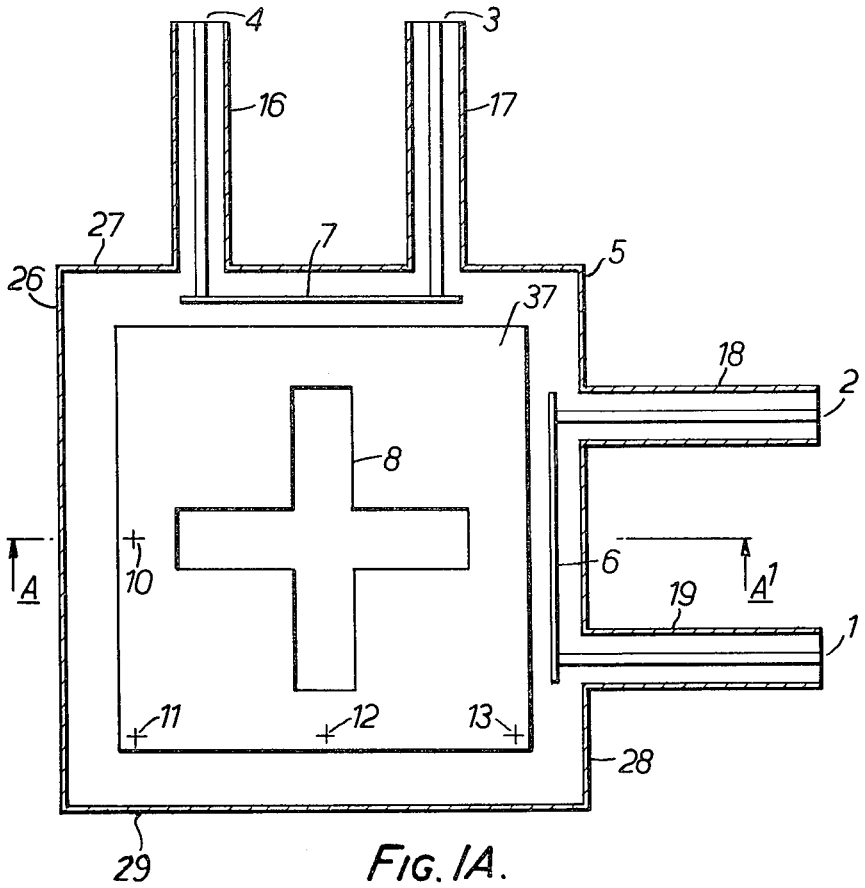

This invention relates to electrical networks for use at high frequencies, that is to say, frequencies of the order of 1 MHz and greater and more specifically to electrical networks exhibiting frequency dependent characteristics, e.g. filter networks. The invention is primarily applicable to so-called constant resistance circuits, that is to say, to circuits which ideally exhibit a constant input and/or output resistance which is independent of frequency and contains no reactive component. Circuits of this kind may be constructed of coaxial lines but the necessary inclusion within such circuits of diplexers results in a complex, bulky and expensive structure. Similarly circuits of this kind may instead be composed of waveguide structures. However, as is known, waveguides are particularly bulky and expensive items and the present invention seeks to provide an electrical network which is inherently simpler or less expensive to construct than previously known circuits of this kind.

According to this invention, a constant resistance electrical network includes a resonator plate mounted within a cavity and two coupling loops arranged as transmission lines exhibiting the same characteristic resistance as each other, each loop being mounted adjacent to the resonator plate and the wall of the cavity so as to be electrically insulated from each with the two ends of each loop passing through the wall and being connected to the centre conductor of an input and an output coaxial line respectively, each coaxial line having said characteristic impedance and each output coaxial line being terminated by the characteristic resistance and with the plane of each loop being parallel to the resonator plate whereby when energy is applied to one input coaxial line none is reflected thereby, and the energy is shared between the two output coaxial lines in dependence on the frequency of the energy in relation to the resonant frequency of the plate.

Preferably the two input coaxial lines are also each terminated by the characteristic resistance.

Preferably each coupling loop comprises an electrically conductive member mounted substantially parallel to and spaced apart from the inner wall of the cavity.

Preferably again each conductive member comprises a thin sheet conductor.

Preferably the resonator plate is square, and the coupling loops are mounted adjacent to contiguous straight edges of the plate.

Preferably again the electrical length of each side of the square resonator plate is approximately half a wavelength at the resonant frequency.

Preferably the plate is provided with a centrally disposed aperture, the size of which influences the actual resonant frequency of the plate.

Preferably again the aperture is in the form of a cross having each limb aligned with the sides of the plate.

In order to provide a network having more than a single resonant frequency, more than one resonator plate can be provided and in such a case where two plates are provided, they are, preferably, capacitively coupled together. They may be arranged one above the other, or they may both lie in a common plane.

Figure 1B:
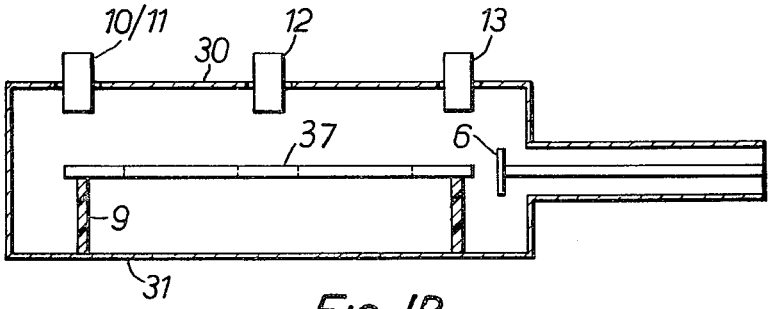
Figure 2:
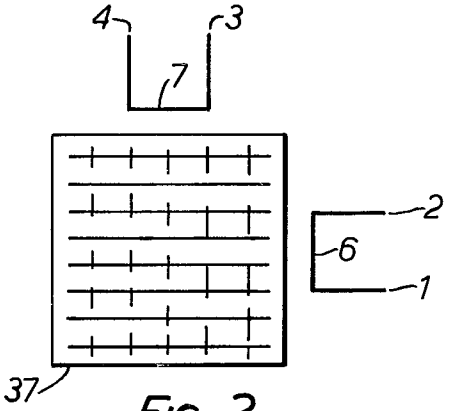
Figure 4B:
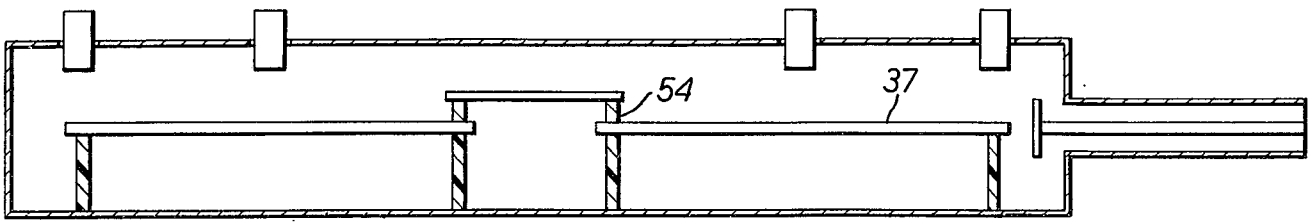
Figure 3:
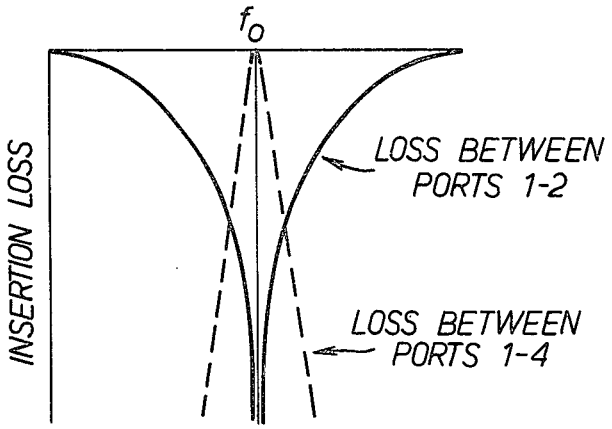
Figure 5:
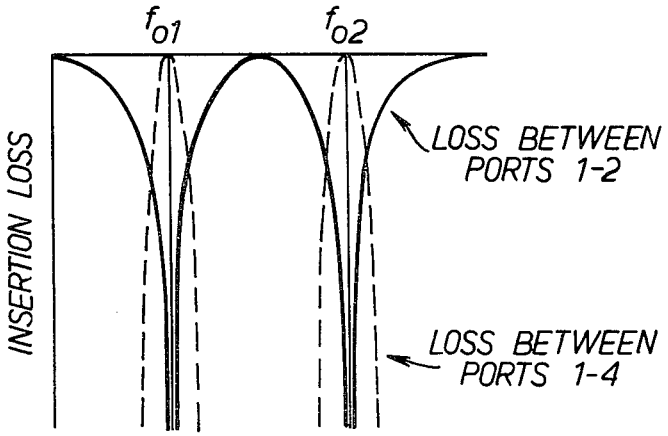

The invention is further described, by way of example, with reference to the accompanying drawings in which, FIGS. 1A, 1B and 4A, 4B illustrate alternative embodiments of the invention, and FIGS. 2, 3 and 5 are explanatory diagrams relating thereto.

Referring to FIG. 1 the upper drawing, labelled "FIG. 1A" consists of a plan sectional view of a circuit consisting of four ports 1, 2, 3, 4, and a cavity 5 to which the ports are coupled. Each of the ports 1, 2, 3 and 4 consists of a length of coaxial line having impedance transforming sections 16, 17, 18, 19. A sectional side view taken on the line $AA^1$ is shown in FIG. 1B. The cavity 5 consists of a short section of waveguide the wall of which comprises four wall portions 26, 27, 28 and 29 bounded by top and bottom end plates 30 and 31. Ports 1 and 2 are mounted on the wall portion 28 and are linked together by means of a coupler 6 consisting of a thin conductive sheet. Similarly ports 3 and 4 are mounted on the wall portion 27 and are provided with a coupler 7. The couplers 6 and 7 are mounted parallel to but spaced apart from their respective walls so as not to make electrical contact therewith. The ends of each coupler are connected to the centre conductor of the coaxial line to form a coupling loop within the cavity. For normal operation each of the coaxial lines forming the ports 1, 2, 3 and 4 is terminated with its characteristic impedance. It is not essential for the couplers 6 and 7 to be mounted in adjacent wall portions and they could be mounted on opposite walls. A square resonator plate 37 is mounted within the cavity 5 as shown on insulating legs 9 with its plane aligned with that of the couplers 6 and 7. Its sides are approximately half a wavelength long at the centre frequency at which the network is to be used. It is, of course, the effective electrical length which is relevant here, and this may differ slightly from its actual physical length. In order to allow the same cavity 5 to be used with different frequencies, a central cross-shape aperture 8 is provided through the plate 37. The size of the aperture greatly affects the resonant frequency of the plate, and for a fairly large aperture such as is illustrated the electrical dimensions of the plate differ significantly from its physical dimensions. The cavity 5, itself, does not primarily affect the resonant frequency of the network, but it does affect its Q value. Fine tuning slugs 10, 11, 12, 13 are provided in the top wall 30 of the cavity 5 and their degree of insertion into the cavity allows the resonant frequency to be precisely adjusted.

In operation port 1 is isolated from port 3 and port 2 is isolated from port 4. Power which is not at the resonant frequency of the plate and which is fed into port 1 is normally delivered to port 2 and similarly power fed into port 3 is normally delivered to port 4. However, when power is fed into port 1 at the resonant frequency then power is delivered to port 4 and not to port 2. Similarly, at the resonant frequency power fed into port 3 is delivered to port 2. The behaviour of the circuit may be explained in terms of the components of a circularly polarised waveguide mode. Referring to FIG. 2, power fed into port 1 causes a voltage to appear between the coupler 6 and the plate 37 by virtue of the capacitance present between the coupler and the wall. At resonance oscillations are set up within the plate with the electric field normal to the plane of the coupler as is shown by the solid line of FIG. 2. In a similar manner current flowing in the coupler 6 sets up oscillations within the cavity with the electric field in the plane of the coupler as represented by the broken line on FIG. 2. If the loops are terminated in resistive loads equal to the characterisitc resistance it follows that the two oscillation modes are of equal magnitude and in time and space quadrature and that a circularly polarised field exists within the cavity in which the plate is situated with the resultant electric vector rotating about the axis of the plate. From this it follows that the relative positions of the two couplers is not critical and that the circuit behaves as a directional coupler of varying sensitivity which is determined by the resonator plate characteristic. The network presents a constant resistance to ports 2 and 3, the value of which is independent of the frequency applied to port 1 and which, when the couplers are correctly dimensioned, contains no reactive component.

When ports 2, 3 and 4 are terminated with their characteristic impedances and a source of variable frequency is applied to port 1, a transfer characteristic is obtained which is illustrated in FIG. 3. The transfer characteristic shows the variation of insertion loss at port 2 against frequency. At frequencies well below resonance the whole of the power applied to terminal 1 is passed to terminal 2, the coupling within the cavity being negligible. As the frequency increases to the resonant frequency of the plate (represented at $f_o$) the whole of the energy is transferred out to port 4. No energy is passed to either of ports 2 or 3 under this condition. As the input frequency increases above resonant frequency the power fed to port 4 reduces until the whole of the power is again obtained at port 2. By careful design and tuning of the cavity, plate and coupling, the sides of the slope of the transfer characteristic in the region of the resonant frequency $f_o$ may be made very steep. This results in a circuit having a very high Q factor. The resonance frequency has a wavelength $\lambda$ where $\lambda/2$ is the electrical length of the plate 37, as mentioned previously.

The invention is most advantageously applicable to the combination of two signals, for example, the combination of a vision carrier signal with the audio carrier signal at the final stage of a television transmitter. The audio carrier frequency is applied to port 1 of a cavity having a plate resonant at that frequency and the vision carrier signal is applied to terminal 3. The separation of the carrier frequencies of the sound and vision signals respectively is sufficiently great such that the plate 37 is essentially non-resonant at the vision carrier frequency. This means that the vision carrier frequency is passed to port 4 substantially unmodified. However, as indicated previously, virtually the whole of the energy applied to port 1 is coupled to port 4 also, and thus a combined output is obtained from port 4. Typically the output of port 4 would be radiated directly from a common radiator. The advantage of this kind of circuit is that in practice substantially no energy from port 1 is coupled to port 3 and conversely substantially no energy applied to port 3 is coupled to port 1. In this way a very high isolation is maintained between the sound and vision transmission systems. Furthermore, because the circuit exhibits the constant resistance characteristic, the power of the radiated signal does not vary with frequency.

Figure 4A:
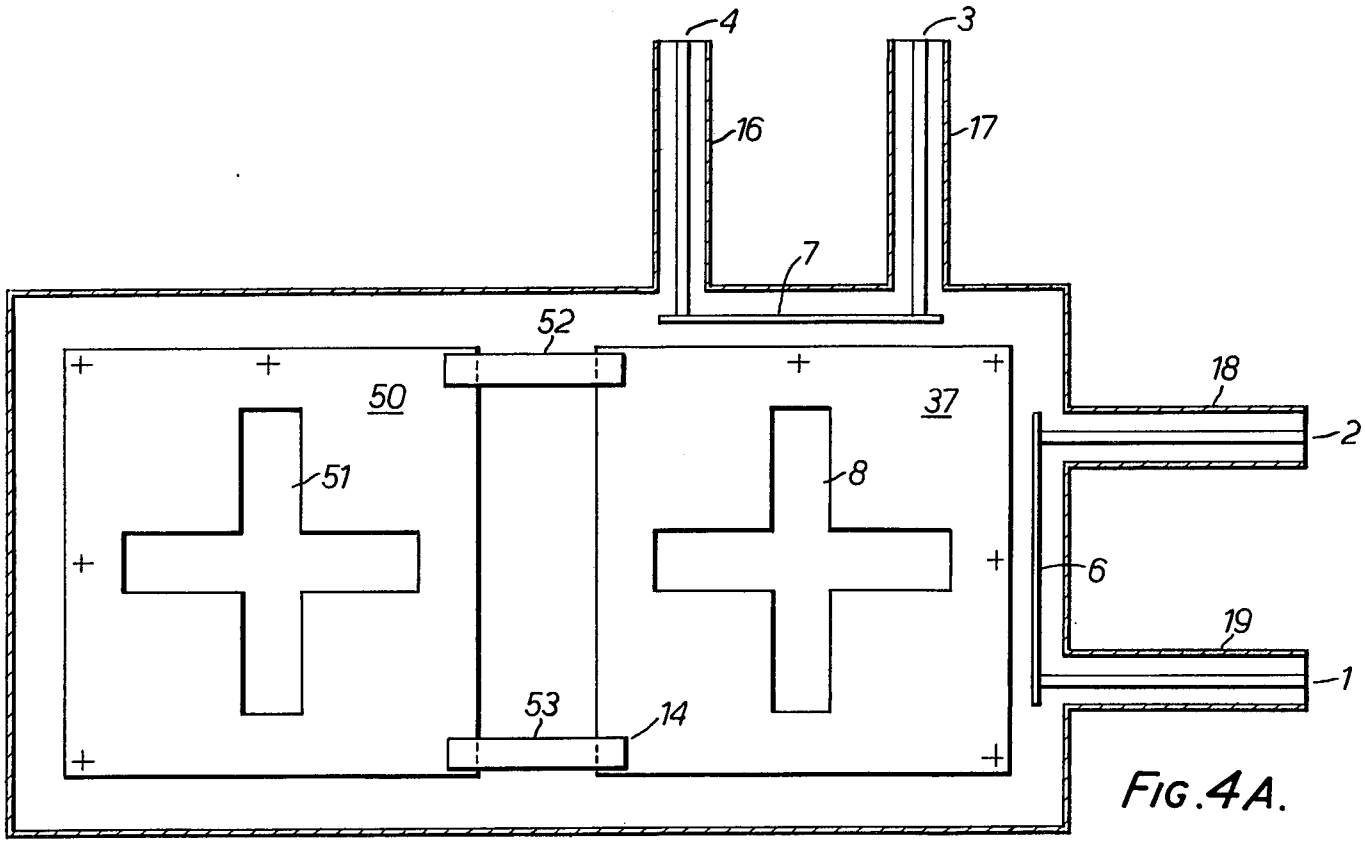

By combining two or more resonant plates together transfer characteristics can be obtained which are more complex than that shown in FIG. 3. One example of a network of this kind is shown in FIGS. 4A and 4B, in which FIG. 4A is a plan view and FIG. 4B is a section view in the same manner as FIGS. 1A and 1B. Where possible like parts are numbered as in FIG. 1. The present network differs in that an additional resonant plate 50 is provided; it is in the same plane as plate 37, and has a similar cross shape aperture 51. It is coupled capacitively to plate 37 via a pair of conductive straps 52, 53 mounted on insulating pegs 54.

The modified transfer characteristic is shown in FIG. 5, and it will be seen that two resonant frequencies are now produced.

I claim:

1. A constant resistance electrical network including a resonator plate mounted within a cavity and two coupling loops arranged as transmission lines exhibiting the same characteristic resistance as each other, each loop being mounted adjacent to the resonator plate and the wall of the cavity so as to be electrically insulated from each with the two ends of each loop passing through the wall and being connected to the centre conductor of an input and an output coaxial line respectively, each coaxial line having said characteristic resistance and each output coaxial line being terminated by the characteristic resistance and with the plane of each loop being parallel to the resonator plate whereby when energy is applied to one input coaxial line none is reflected thereby, and the energy is shared between the two output coaxial lines in dependence on the frequency of the energy in relation to the resonant frequency of the plate.

2. A network as claimed in claim 1 and wherein the two input coaxial lines are also each terminated by the characteristic resistance.

3. A network as claimed in claim 1 and wherein each coupling loop comprises an electrically conductive member mounted substantially parallel to and spaced apart from the inner wall of the cavity.

4. A network as claimed in claim 3 and wherein each conductive member comprises a thin sheet conductor.

5. A network as claimed in claim 1 and wherein the resonator plate is square, and the coupling loops are mounted adjacent to contiguous straight edges of the plate.

6. A network as claimed in claim 5 and wherein the electrical length of each side of the square resonator plate is approximately half a wavelength at the resonant frequency.

7. A network as claimed in claim 5 and wherein the plate is provided with a centrally disposed aperture, the size of which influences the actual resonant frequency of the plate.

8. A network as claimed in claim 7 and wherein the aperture is in the form of a cross having each limb aligned with the sides of the plate.

9. A network as claimed in claim 1 and wherein in order to provide a network having more than a single resonant frequency, more than one resonator plate is provided.

10. A network as claimed in claim 9 and wherein, where two plates are provided, they are capacitively coupled together.

11. A constant resistance electrical network comprising, in combination:

a cavity structure;

first coaxial line coupling loop means for coupling energy into said cavity structure and including an inlet port and an outlet port lying in a common plane;

second coaxial line coupling loop means for coupling energy into said cavity structure and including an inlet port and an outlet port lying in a common plane;

resonator plate means comprising at least one plate lying in a plane within said cavity structure parallel to the planes of said coupling means for controlling the coupling of energy between said coupling loop means, said resonator plate means having at least one resonant frequency which is the resonant frequency of said one plate; and means terminating each of said ports with its characteristic impedance whereby energy supplied at said one resonant frequency to the input port of one coupling loop means is not reflected thereby but coupled substantially only to the output port of the other coupling loop means whereas energy supplied at a frequency substantially different from any resonant frequency of the resonator plate means to the input port of said other coupling loop means is not reflected thereby but is coupled substantially only to the output port of said other coupling means.

12. A constant resistance electrical network comprising, in combination:

a cavity structure;

a pair of separate couplers disposed within said cavity in electrically insulated relation thereto;

a first input coaxial line and a first output coaxial line leading to said cavity structure and each having a center conductor connected to opposite ends of one coupler to form a first planar coupling loop having a predetermined characteristic impedance;

a second input coaxial line and a second output coaxial line leading to said cavity structure and each having a center conductor connected to opposite ends of the other coupler to form a second planar coupling loop having a characteristic impedance which is the same as that of said first loop;

means terminating each of said coaxial lines in said characteristic impedance whereby when energy is applied to either input coaxial line none is reflected thereby and two oscillation modes which are equal in magnitude and in time and space quadrature exist within the cavity structure; and a resonant plate disposed within said cavity structure in a plane parallel to the planes of said pair of coupling loops and spaced therefrom, said plate being constructed to have the same electrical length as said oscillation modes whereby, at a predetermined frequency of energy applied to said first input coaxial line, said plate is in electrical resonance so as to couple substantially all of the energy applied to said first input coaxial line to said second coaxial output line whereas energy applied to said second input coaxial line at a frequency substantially different from said predetermined frequency is also coupled substantially wholly to said second coaxial output line.

* * * * *